United States Patent [19]

Jugle

[11] 4,065,305

[45] Dec. 27, 1977

[54] XEROGRAPHIC DEVELOPER

[75] Inventor: Don B. Jugle, Penfield, N.Y.

[73] Assignee: Xerox Corporation, Stamford, Conn.

[21] Appl. No.: 662,644

[22] Filed: Mar. 1, 1976

[51] Int. Cl.[2] ..... G03G 9/10; G03G 13/08

[52] U.S. Cl. ..... 96/1 SD; 252/62.1 P; 427/19

[58] Field of Search ..... 252/62.1 P; 427/19; 96/15 D

[56] References Cited

U.S. PATENT DOCUMENTS

| | | | |
|---|---|---|---|
| 3,236,776 | 2/1966 | Tomanek | 252/62.1 P |
| 3,781,207 | 12/1973 | Tamm | 252/62.1 P |
| 3,847,604 | 11/1974 | Hagenbach et al. | 252/62.1 P X |
| 3,895,125 | 7/1975 | Tsuchiya et al. | 252/62.1 P X |

*Primary Examiner*—James R. Hoffman

[57] ABSTRACT

An improved developer mixture comprising from between about 0.3 and about 5.0 percent by weight of finely-divided colored toner particles blended with at least about 95 percent by weight of carrier particles having an average particle size of between about 30 and 1,000 microns. The carrier particles comprise a mixture of particles wherein from between about 99 percent and about 90 percent by weight of the carrier particles have an average diameter of approximately the same size, and wherein from about 1 percent to about 10 percent by weight of the carrier particles have an average diameter substantially larger than the other carrier particles. Electrostatographic imaging processes employing the developer mixtures are also disclosed.

10 Claims, No Drawings

XEROGRAPHIC DEVELOPER

BACKGROUND OF THE INVENTION

This invention relates in general to imaging systems and more particularly to improved electrostatographic developer mixtures for use in such systems.

The formation and development of images on the surface of photoconductive material by electrostatographic means is known. The basic electrostatographic process as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light, and developing the resultant latent electrostatic image by depositing on the image, a finely-divided electroscopic material referred to in the art as "toner". The toner is attracted to those areas of the layer which retain a charge, thereby forming a toner image corresponding to the latent electrostatic image. This "powder" image may then be transferred, usually electrostatically, to a support surface such as paper. The transferred image may subsequently be permanently affixed to the support surface by heat or other suitable affixing means such as solvent or overcoating treatment, may be used instead.

Many methods are known for applying the electroscopic particles to the latent image to be developed. One development method as disclosed by E. N. Wise in U.S. Pat. No. 2,618,582 is known as "cascade" development. In this method, developer material, comprising relatively large carrier particles, having finely-divided toner particles electrostatically clinging to the surface of the carrier particles, is conveyed to, and rolled, or cascaded across the surface bearing the latent electrostatic image. The charged portions of the surface have a charge of the same polarity as, but stronger than, the carrier particles. Toner and carrier particles having opposite polarities are selected so that the toner particles cling to the carrier particles. In order to develop a negatively charged electrostatic latent image, a toner and carrier combination is selected in which the toner is triboelectrically positive in relation to the carrier. Conversely, to develop a positively charged electrostatic latent image, a toner and carrier combination in which the toner is triboelectrically negative in relation to the carrier, is used. The triboelectric relationship between the toner and carrier depends on the relative positions of the materials in the "triboelectric series". In this series, materials are arranged in ascending order of the ability to take on a positive charge. Each material is positive with respect to any material classified below it in the series; and, negative with respect to any material above it in the series. As the mixture cascades or rolls across an image-bearing surface, the toner particles are electrostatically attracted from the carrier, partially to the charged portions of the image-bearing surface, whereas they are not electrostatically attracted to the uncharged or background portions of the image which they contact. The carrier particles and unused toner particles are then recycled. The cascade development process is extremely good for the development of line copy images, and is the most widely used commercial xerographic development technique. A general purpose office copying machine incorporating this technique is described in U.S. Pat. No. 3,099,943.

Another technique for developing electrostatic images is the "magnetic brush" process as disclosed for example, in U.S. Pat. No. 2,874,063. In this process, a developer material containing toner and magnetic carrier particles is attracted to and is carried by a magnet. The magnetic field causes alignment of the magnetic particles in a brush-like configuration when this magnetic brush is brought into contact with an electrostatic image-bearing surface, and the toner partcles are attracted from the carrier particles of the brush to the charged areas of the image-bearing surface but not to the uncharged areas. Since the charged areas have an imagewise configuration, the toner material clings to the surface in imagewise configuration, thus developing the latent image.

Another method for developing electrostatic latent images is disclosed in U.S. Pat. No. 3,503,776 issued to R. W. Gundlach. In this method, images are formed by transporting an electrostatic latent image-bearing surface in a generally ascending arcuate path, and contacting only the image in a contact zone with a bath of developer material transported in a concave chamber adjacent the lower path of the imaging surface. The contact zone extends from about the lowermost point of the arcuate path to the uppermost point of the arcuate path, frictional contact between the developer and the imaging surface in the contact zone circulates the developer in the bath and brings developer material into developing configuration with the imaged surface.

Many other methods, such as the "touchdown" development method disclosed by C. R. Mayo in U.S. Pat. No. 2,895,847, are known for applying electroscopic particles to the electrostatic latent image to be developed. The development process, as described above, together with numerous modifications, are well known to the art through various patents and publications and through the widespread availability and utilization of electrostatographic imaging equipment.

Most past and present electrostatographic development machines require a developer mixture to slide down an inclined plane inside the developer housing. The quality of the developed electrostatic latent image, as regards the developer mixture, is predicated to a great extent upon the supply of developer material to the latent image. Heretofore, it has not been possible to maximize the supply of developer material to the latent image due to agglomeration, blocking, or resistance to flow by the developer material in the developer housing.

The resistance to developer flow is generally a function of the developer material and the configuration of the developer housing. In order to allow maximum developer storage space in a typical developer housing, one of its sides is usually nearly horizontal. However, in order for the developer material to flow on any side of the housing, the housing must be at or greater than the angle of slide of the developer material. For small particulate developer materials having two or more components of the typical types used in electrostatographic devices, the angles of slide are appreciable and are typically between 20° and 50° from the horizontal. This property oftentimes constraints the design of a developer housing, or due to slight variations in the developer material shape and/or its triboelectrification characteristics requires the modification of an initial machine design. Therefore, recent efforts have been directed toward the provision of an increased supply of developer material to the latent image consistent with the increased demands of machine configurations requiring faster copy throughput. Thus, in view of the ascending importance in providing increased supplies of developer material to latent images during the development step in electrostatographic copying and duplicating devices, it is an object of the present invention to provide developer mixtures having the advantages, but not the disadvantages, attached to such developer mixtures.

It is a further object of the present invention to provide developer mixtures which enable reduction of the angle necessary to cause developer material to slide down inclined planes in electrostatographic copying and/or duplicating devices.

It is another object of the present invention to provide carrier materials which possess improved physical properties for more efficient and prolonged use in electrostatographic reproduction processes.

It is yet another object of the present invention to provide carrier materials and developer mixtures which flow more freely in reproduction devices.

It is a further object of the present invention to provide carrier materials and developer mixtures having improved and more stable triboelectric charging characteristics.

It is yet a further object of the present invention to provide carrier materials and developer mixtures having increased developer life.

It is still another object of the present invention to provide carrier materials and developer mixtures having physical and triboelectric charging properties superior to those of known carrier materials and developer mixtures.

Other objects of this invention will be apparent from the ensuing description herein.

In accordance with the present invention, there is provided a developer mixture comprising a blend of:

a. about 0.3 and 5.0 percent, based on the weight of the developer mixture, of a finely-divided pigmented resin toner, the particles of which have an average particle size in the range of about 5 to 30 microns; and, b. from between about 95 and 99.7 percent, based on the weight of the developer mixture, of carrier particles having an average particle size in the range of about 30 to 1,000 microns capable of triboelectrifying said toner particles whereby toner is caused to electrostatically cling to the surfaces of the carrier particles, the carrier particles comprising a mixture of particles wherein from about 99 percent to about 90 percent by weight of the carrier particles have an average particle diameter of approximately the same size, and wherein from about 1 percent to about 10 percent by weight of the carrier particles have an average diameter larger than the other carrier particles. It has been found that the developer mixtures of this invention provide improved electrostatographic development systems wherein the angle of slide of the developer material is decreased in an electrostatographic copying and/or duplicating device as to result in increasing the flow rate of the developer material and thus increase the developability rate of the device. In addition, by lowering the angle at which the developer material will flow, such will provide for a larger capacity developer sump where space is critical.

More specifically, it has been found that where the carrier particles of this invention comprise from between about 1 percent and about 3 percent by weight of the larger sized carrier particles, the angle at which the developer mixture will flow is decreased as to provide satisfactory improvement in the developer flow rate. However, it is preferred that the larger sized carrier particles comprise from between about 4 percent and about 6 percent by weight of the carrier particles in order to obtain the maximum effective decrease in the angle of slide of the developer mixture. Only slight additional decreases in the angle of slide of the developer mixture are obtained when the carrier particles comprise from between about 6 percent and about 10 percent by weight of the larger sized carrier particles.

Thus, generally speaking, when the smaller sized carrier particles are in the particle size range of between about 75 and about 125 microns in diameter, the larger sized carrier particles should have an average particle diameter in the range of between about 200 and about 300 microns in diameter. In general, the larger sized carrier particles should have an average particle diameter in the range of between about 2 and about three times the diameter of the smaller sized carrier particles.

Any suitable well known coated or uncoated electrostatographic carrier bead material may be employed as the carrier particles of this invention. Typical carrier materials include sodium chloride, ammonium chloride, aluminum potassium chloride, Rochelle salt, sodium nitrate, potassium chlorate, granular zircon, granular silicon, methyl methacrylate, glass, silicon dioxide, flintshot, iron, steel, ferrite, nickel, zinc, lead, Carborundum, and mixtures thereof. Many of the foregoing and other typical carriers are described by L. E. Walkup in U.S. Pat. No. 2,618,551; L. E. Walkup et al in U.S. Patent No. 2,638,416 and E. N. Wise in U.S. Pat. No. 2,618,552. The carrier materials which are preferred in accordance with this invention include materials such as nickel, steel, iron, ferrites and the like. The surface of the carrier material may be irregular, spherical, smooth, or rough, and the carrier material may be solid or hollow. A solid, spherical carrier bead having a smooth surface is preferred for electrostatographic use because the carrier bead then possesses sufficient density and inertia to avoid adherence to the electrostatic latent image during the cascade development process, and also provides improved results in accordance with the invention.

Any suitable well-known carrier coating material may be employed for coating the carrier materials of this invention. Typical carrier coating materials include natural resin, thermoplastic resin, or partially cured thermosetting resin. Typical natural resins include: caoutchouc, colophony, copal, dammar, dragon's blood, jalop, storax, and mixtures thereof. Typical thermoplastic resins include: the polyolefins such as polyethylene, polypropylene, chlorinated polyethylene, and chlorosulfonated polyethylene; polyvinyls and polyvinylidenes such as polystyrene, polymethylstyrene, polymethymethacrylate, polyacrylonitrile, polyvinylacetate, polyvinylalcohol, polyvinylbutyral, polyvinylchloride, polyvinylcarbazole, polyvinyl ethers, and polyvinyl ketones; fluorocarbons such as polytetrafluoroethylene, polyvinylfluoride, polyvinylidene fluoride; and polychlorotrifluoroethylene; polyamides such as polycaptrolactamo and polyhexamethylene adipimide; polyesters such as polyethylene terephthalate; polyurethanes; polysulfides; polycarbonates; and mixtures thereof. Typical thermosetting resins include: phenolic resins such as phenol formaldehyde, phenol furfural and resorcinol formaldehyde; amino resins such as urea formaldehyde and melamine formaldehyde; polyester resins; epoxy resins; and mixtures thereof. A styrenemethacrylate organosiloxane terpolymer carrier coating composition such as described in U.S. Pat. No.

3,526,533 is particularly preferred because of its excellent triboelectric characteristics.

Any suitable coating thickness may be applied to the carrier cores. However, a carrier coating having a thickness at least sufficient to form a thin continuous film on a substrate is preferred because the carrier coating will then possess sufficient thickness to resist abrasion and prevent pinholes which adversely affect the triboelectric properties of the coated carrier particles. Generally, the carrier coating material may comprise from about 0.01 percent to about 1.0 percent by weight based on the weight of the coated carrier particles. Preferably, the electrostatographic carrier coating material should comprise from about 0.1 percent to about 0.6 percent by weight based on the weight of the coated carrier particles because maximum durability, triboelectric response, and copy quality are achieved. To achieve further variation in the properties of the coating materials, well-known additives such as plasticizers, reactive and non-reactive polymers, dyes, pigments, wetting agents, and mixtures thereof may be mixed with the carrier coating material.

Any suitable pigmented or dyed electroscopic toner material may be employed with the carrier materials of this invention. Typical toner materials include: gum sandarac, rosin, cumaroneindene resin, asphaltum, gilsonite, phenol-formaldehyde resins, methacrylic resins, polystyrene resins, polypropylene resins, epoxy resins, polyethylene resins, and mixtures thereof. The particular toner material to be employed obviously depends upon the separation of the toner particles from the carrier beads in the triboelectric series. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Patent Reissue 25,136 to Carlson and U.S. Pat. No. 2,788,288 to Rheinfrank et al. These toners generally have an average particle diameter between about 1 and about 30 microns.

Any suitable toner concentration may be employed with the carrier materials of this invention. Typical toner concentrations for cascade development systems include about 1 part toner with about 10 to about 400 parts by weight of carrier.

Any suitable colorant such as a pigment or dye may be employed to color the toner particles. Toner colorants are well known and include, for example, carbon black, nigrosine dye, aniline blue, Calco Oil Blue, chrome yellow, ultramarine blue, Quinoline Yellow, methylene blue chloride, Monastral Blue, Malachite Green Ozalate, lampblack, Rose Bengal, Monastral Red, Sudan Black BM, and mixtures thereof. The pigment or dye should be present in the toner in a sufficient quantity to render it highly colored so that it will form a clearly visible image on a recording member. Preferably, the pigment is employed in an amount of from about 3 percent to about 20 percent, by weight, based on the total weight of the colored toner because high quality images are obtained. If the toner colorant employed is a dye, substantially smaller quantities of colorant may be used.

Any suitable organic or inorganic photoconductive material may be employed as the recording surface with the carrier materials of this invention. Typical inorganic photoconductor materials include: sulfur, selenium, zinc sulfide, zinc oxide, zinc cadmium sulfide, zinc magnesium oxide, cadmium selenide, zinc silicate, calcium strontium sulfide, cadmium sulfide, mercuric iodide, mercuric oxide, mercuric sulfide, indium trisulfide, gallium selenide, arsenic disulfide, arsenic trisulfide, arsenic triselenide, antimony trisulfide, cadmium sulfoselenide and mixtures thereof. Typical organic photoconductors include: quinacridone pigments, phthalocyanine pigments, triphenylamine, 2,4-bis(4,4'-diethylamino-phenol)-1,3,4-oxadiazol, N-isopropylcarbazole, triphenylpyrrol, 4,5-diphenyl-imidazolidinone, 4,5-diphenyl-imidazolidinethione, 4,5-bis(4'-amino-phenyl)-imidazolidinone, 1,5-dicyanonaphthalene, 1,4-dicyanonaphthalene, aminophthalodinitrile, nitrophthalodinitrile, 1,2,5,6-tetraazacyclooctatetraene-(2,4,6,8), 2-mercaptobenzothiazole-2-phenyl-4-disphenylidene-oxazolone, 6-hydroxy-2,3-di(p-methoxyphenyl)-benzofurane, 4-dimethylamino-benzylidene-benzhydrazide, 3-benzylidene-amino-carbazole, polyvinyl carbazole, 1,2,4-triazine, 5-diphenyl-3-methylene-pyrazoline, 2-(4'-dimethylamino phenyl)-benzoxazole, 3-amino-carbazole, and mixtures thereof. Representative patents in which photoconductive materials are disclosed include U.S. Pat. Nos. 2,803,542 to Ullrich, 2,970,906 to Bixby, 3,121,006 to Middleton, 3,121,007 to Middleton, and 3,151,982 to Corrsin.

Developer mixtures of the present invention are particularly useful in cascade reproduction systems employing a development electrode. The developer mixtures of this invention provide excellent print quality, i.e., high print density and low background development levels. By employing the carrier materials of the present invention, the over-all development capability of the developer mixture can be greatly increased over that of conventional developer materials. The apparent mechanism for this beneficial effect is that the angle of slide of a developer mixture has been found to be a function of the diameter of the carrier beads and to some extent the triboelectric characteristics of the developer mixture.

The triboelectric characteristics of a developer mixture are important because of impedance to flow of the carrier particles caused by the toner particles which are electrostatically held to the carrier particles, i.e., the toner particles act as chocks for the carrier particles. As the carrier particles become smaller this effect becomes more dominant. In general, the chocking effect of the toner particles may be said to be an extrinsic source in increase in the coefficient of friction between the mass of carrier particles and any plane surface. The sliding coefficient of friction is usually less than the static coefficient of friction. As regards developer mixtures, the coefficient of friction may be referred to as the angle of slide. It has been found that if some of the carrier particles in the developer mass are caused to roll at lower angles than those predominant in the developer mass, the whole mass will slide at lower angles, hence, increasing the developer flow rate for any given developer housing configuration.

In accordance with this invention, as the size of some of the carrier particles increases, the chocking effect of the toner particles decreases. Hence, where larger-sized carrier particles are introduced to the developer mass, the developer flow rate may generally be increased for developer mixtures having marginally low angles of slide as dictated by machine design considerations. Since carrier particles are generally distributions of sizes, the developer mixture may be optimized for any given situation in accordance with his invention. Consequently, when the angle of slide is reduced in an electrostatographic reproduction device, the developer flow rate increases and likewise the developability of the system.

The following examples further define, describe and compare methods of preparing the carrier materials of the present invention and of utilizing them to develop electrostatic latent images. Parts and percentages are by weight unless otherwise indicated.

In the following examples, the angle of slide and the developer flow rates were measured as follows: For the angle of slide measurements, the apparatus used was a Water Break tester manufactured by the Precision Machine and Development Corporation. The apparatus consisted of a slowly rotating clock motor with an on-off controlling switch. The motor very slowly tilted (about 70°/minute) a plane surface of the same material as the inclined plane in an electrostatographic device and at the same time indicated the angle of the surface to the horizontal. A developer mixture was sprinkled onto the plane surface in varying thicknesses from non-uniform layers to layers one millimeter in thickness. The surface was tilted until substantially all of the developer mixture fell off the surface. The switch was then shut off and the angle measured. This procedure was repeated between five and ten times for each developer mixture tested. The results clearly showed that controlled amounts of carrier particles the diameter of which are generally a little greater than twice that of the majority of the carrier particles will slide at significantly lower angles as compared to the unaltered carrier mass.

In order to verify the usefulness of this concept in an operating electrostatographic machine the following experiment was conducted. A magnetic brush developer housing was equipped with an apparatus for measuring the developer flow rate. The data clearly showed the advantages of utilizing a controlled mixture of large and small carrier particles. The effects are dramatic because the baffle which controlled the flow to the magnetic brush roller was, because of design constraints, at a sufficiently shallow angle so that flow to it was marginal and difficult to maintain.

EXAMPLE I

A control developer mixture was prepared by mixing about 1,000 grams of carrier particles having an average particle size of about 100 microns with about 25 grams of toner particles having an average particle size of about 14 microns. The carrier particles were made of steel and were coated with about 0.4 percent by weight of a styrene-methacrylate-organosiloxane terpolymer as disclosed in U.S. Pat. No. 3,526,533. The toner particles consisted of a polyester polymer and carbon black, along with a stearate metal salt, and silica particles. The developer mixture was roll-milled for about 30 minutes prior to the angle of slide measurements. A monolayer of the developer mixture was sprinkled onto the plane surface, in this case aluminum, of the test apparatus discussed above and the angle of slide measured when the developer mixture fell off the surface. The ambient room temperature was about 71° F and the relative humidity was about 30 percent. The angle of slide for this developer mixture was determined to be about 56°.

EXAMPLE II

A developer mixture was prepared as in Example I except that to the developer mixture was added about 1, 5 and 10 percent by weight, respectively, of carrier particles having an average particle size of about 250 microns. The 250 micron carrier particles were made of steel and were coated with about 0.4 percent by weight of the terpolymer material of Example I. Under substantially identical conditions as in Example I, it was found that the angle of slide for the developer mixtures containing 1, 5 and 10 percent of the 250 micron size carrier particles decreased to about 54°, 50° and 51°, respectively.

EXAMPLE III

The developer mixture of Example I was tested as in Example I except that a layer of about 0.5 millimeter in thickness of the developer mixture was sprinkled onto the aluminum surface of the angle of slide test apparatus. Under substantially identical conditions as in Example I, the angle of slide for the developer mixture was determined to be about 54°.

EXAMPLE IV

The developer mixture of Example I was tested as in Example III except that to the developer mixture was added about 1, 5 and 10 percent by weight respectively of carrier particles having an average particle size of about 250 microns. The 250 micron carrier particles were made of steel and were coated with about 0.4 percent by weight of the terpolymer material of Example I. Under substantially identical conditions as in Example III, it was found that the angle of slide for the developer mixtures containing 1, 5 and 10 percent of the 250 micron size carrier particles decreased to about 52°, 47°, and 50°, respectively.

EXAMPLE V

The developer mixture of Example I was tested as in Example I except that a layer about 1 millimeter in thickness of the developer mixture was sprinkled onto the aluminum surface of the angle of slide test apparatus. Under substantially identical conditions as in Example I, the angle of slide for the developer mixture was determined to be about 44°.

EXAMPLE VI

The developer mixture of Example I was tested as in Example V except that to the developer mixture was added about 1, 5 and 10 percent by weight respectively of carrier particles having an average particle size of about 250 microns. The 250 micron carrier particles were made of steel and were coated with about 0.4 percent by weight of the terpolymer material of Example I. Under substantially identical conditions as in Example V, it was found that the angle of slide for the developer mixtures containing 1, 5 and 10 percent of the 250 micron size carrier particles decreased to about 42°, 37°, and 39°, respectively.

EXAMPLE VII

The developer mixture of Example I was roll-milled for about 30 minutes at a temperature of about 72° F and a relative humidity of about 10 percent. The developer mixture was used for measurements of flow rate after set periods in accordance with the procedure discussed above. The flow rate measurements were conducted at a temperature of about 72° F and a relative humidity of about 27 percent. The developer flow rate for this mixture after time intervals of about 30 seconds, 1 minute, 2 minutes, 4 minutes, 8 minutes, 16 minutes, and 32 minutes was found to be about 24.4, 24.9, 25.3, 25.4, 25.4, 25.7, and 25.7 grams/inch-second, respectively.

The foregoing determination was repeated except that about 5 percent by weight of 250 micron size carrier particles was added to the developer mixture. The 250 micron size carrier particles were made of steel and were coated with about 0.4 percent by weight of the terpolymer of Example I. Under substantially identical conditions as in the aforesaid flow rate test, it was found that the developer flow rate for this mixture after time intervals of about 30 seconds, 1 minute, 2 minutes, 4 minutes, 8 minutes, 16 minutes and 32 minutes was about 26.3, 26.6, 27.0, 27.3, 27.2, 26.8, and 26.5 grams-/inch-second, respectively.

Although specific materials and conditions were set forth in the above exemplary processes in making and using the developer material of this invention, these are merely intended as illustrations of the present invention. Various other toners, carrier beads, substituents and processes such as those listed above may be substituted for those in the examples with similar results.

Other modifications of the present invention will occur to those skilled in the art upon reading of the present disclosure. These are intended to be included within the scope of this invention.

What is claimed is:

1. An electrostatographic developer mixture comprising from between about 0.3 and about 5.0 percent by weight, based on the weight of said developer mixture, of finely-divided toner particles having an average particle diameter of from between about 5 to about 30 microns electrostatically clinging to the surface of carrier particles, said carrier particles comprising from between from 95.0 and 99.7 percent by weight based on the weight of said developer mixture, of particles having an average particle diameter of from between about 30 microns and about 1,000 microns, said carrier particles further comprising a mixture of carrier particles wherein from between about 99 percent and about 90 percent by weight of said carrier particles have an average particle diameter of approximately the same size and wherein from between about 1 percent and about 10 percent by weight of said carrier particles have an average diameter of from between about two and about three times larger than the diameter of said carrier particles having an average particle diameter of approximately the same size.

2. An electrostatographic developer mixture in accordance with claim 1 wherein said carrier particles having an average diameter of from between about two and about three time larger than the diameter of said carrier particles having an average particle diameter of approximately the same size are present in an amount of from between about 4 percent and about 6 percent by weight of said carrier particles.

3. An electrostatographic developer mixture in accordance with claim 1 wherein said carrier particles having an average particle diameter of approximately the same size are in the particle size range of between about 75 and about 125 microns in diameter.

4. An electrostatographic developer mixture in accordance with claim 1 wherein said carrier particles having an average diameter of from between about two and about three times larger than the diameter of said carrier particles having an average particle diameter of approximately the same size have an average particle diameter in the range of between about 200 and 300 microns.

5. An electrostatographic developer mixture in accordance with claim 1 wherein said carrier particles are selected from the group consisting of nickel, steel, iron and ferrites.

6. An electrostatographic imaging process comprising the steps of providing an electrostatographic imaging member having a recording surface, forming an electrostatic latent image on said recording surface, and contacting said electrostatic latent image with a developer mixture comprising from between about 0.3 and about 5.0 percent by weight, based on the weight of said developer mixture, of finely-divided toner particles having an average particle diameter of from between about 5 to about 30 microns electrostatically clinging to the surface of carrier particles, said carrier particles comprising from between about 95.0 and 99.7 percent by weight based on the weight of said developer mixture, of particles having an average particle diameter of from between about 30 microns and about 1,000 microns, said carrier particles further comprising a mixture of carrier particles wherein from between about 99 percent and about 90 percent by weight of said carrier particles have an average particle diameter of approximately the same size and wherein from between about 1 percent and about 10 percent by weight of said carrier particles have an average diameter of from between about two and and about three times larger than the diameter of said carrier particles having an average particle diameter of approximately the same size, whereby at least a portion of said finely-divided toner particles are attracted to and deposited on said recording surface in conformance to said electrostatic latent image.

7. An electrostatographic imaging process in accordance with claim 6 wherein said carrier particles having an average diameter of from between about two and about three times larger than the diameter of said carrier particles having an average particle diameter of approximately the same size are present in an amount of from between about 4 percent and about 6 percent by weight of said carrier particles.

8. An electrostatographic imaging process in accordance with claim 6 wherein said carrier particles having an average particle diameter of approximately the same size are in the particle size range of between about 75 and about 125 microns in diameter.

9. An electrostatographic imaging process in accordance with claim 6 wherein said carrier particles having an average diameter of from between about two and about three times larger than the diameter of said carrier particles having an average particle diameter of approximately the same size have an average particle diameter in the range of between about 200 and 300 microns.

10. An electrostatographic imaging process in accordance with claim 6, wherein said carrier particles are selected from the group consisting of nickel, steel, iron and ferrites.

* * * * *